United States Patent [19]

Hagan et al.

[11] 4,446,625

[45] May 8, 1984

[54] APPARATUS FOR MOUNTING FLEXIBLE PRINTING PLATES

[75] Inventors: Edward F. Hagan, E. Brunswick, N.J.; Marvin G. Reaver, Jr., Mount Prospect, Ill.

[73] Assignee: E. I. Du Pont de Nemours and Company, Wilmington, Del.

[21] Appl. No.: 15,934

[22] Filed: Feb. 28, 1979

[51] Int. Cl.[3] ..... B41F 27/00

[52] U.S. Cl. ..... 33/184.5; 101/DIG. 12

[58] Field of Search ..... 101/415.1, 401.3, DIG. 12, 101/174, 212, 216; 242/157 R; 156/130, 171, 173, 187, 391–392, 431, DIG. 11, DIG. 13, 215, 447; 271/232; 33/184.5

[56] References Cited

U.S. PATENT DOCUMENTS

| | | | |
|---|---|---|---|
| 1,013,621 | 1/1912 | Schlueter . | |
| 1,377,511 | 5/1921 | Novotny . | |
| 1,832,255 | 11/1931 | Springstead . | |
| 1,965,216 | 7/1934 | Brown . | |
| 2,021,959 | 11/1935 | Huebner . | |
| 2,131,323 | 9/1938 | Huebner . | |
| 2,339,467 | 1/1944 | Eckhard . | |
| 2,539,965 | 1/1951 | Moss . | |
| 2,668,363 | 2/1954 | Lippitt . | |
| 2,711,031 | 6/1955 | Kessler . | |
| 2,711,691 | 6/1955 | Leavens . | |
| 2,789,629 | 7/1957 | Kaulen | 101/415.1 X |
| 2,907,274 | 10/1959 | Taylor . | |
| 2,984,910 | 5/1961 | La Cour . | |
| 3,186,336 | 6/1965 | Kirby . | |
| 3,390,633 | 7/1968 | Boughton . | |
| 3,613,252 | 10/1971 | Moos | 33/184.5 |
| 3,621,582 | 11/1971 | Radencic . | |
| 3,794,486 | 2/1974 | Luther | 101/DIG. 12 |
| 3,983,808 | 10/1976 | Jackson | 101/401.3 |
| 4,090,904 | 5/1978 | Mahoney . | |

FOREIGN PATENT DOCUMENTS

| | | | |
|---|---|---|---|
| 1273989 | 7/1968 | Fed. Rep. of Germany | 101/DIG. 12 |
| 1447903 | 10/1969 | Fed. Rep. of Germany . | |
| 1917146 | 1/1970 | Fed. Rep. of Germany . | |
| 199200 | 10/1938 | Switzerland . | |

OTHER PUBLICATIONS

Industrial Research Mag.; ". . . IR 100 Winners/Cyrel Photopolymer Flexographic Printing Plate System"; pp. 23, 38, Oct. 1974.

*Primary Examiner*—Clifford D. Crowder

[57] ABSTRACT

An apparatus for mounting flexible printing plates on printing cylinders. A frame is fixed with respect to a printing cylinder and a plate is fixed on the frame by keys. When an end of the plate has been adhered to the cylinder, the keys are detached and the rest of the plate is applied to the cylinder.

8 Claims, 15 Drawing Figures

70
26
68
32
72
74
84
80
12
92
90
82
78
76
86
89
94
88
71
28
52
48
34
42
56
44
54
58
50
40

APPARATUS FOR MOUNTING FLEXIBLE PRINTING PLATES

TECHNICAL FIELD

This invention relates generally to flexographic printing and, more particularly, to the mounting of multiple printing plates in color register on multiple plate cylinders intended for use on a printing press.

BACKGROUND

Equipment with which flexible printing plates can be mounted on printing cylinders and proofed in advance of a printing run is available commercially. After horizontal and vertical center lines have been marked on paper previously applied to a proofing cylinder, those center lines and corresponding indicia on a plate are viewed through optics and aligned manually. Then, the plate is adhered to the cylinder and the image is printed on the proof paper. The same procedure is followed for each of the several plates for a printing run. Any that are misaligned or otherwise out of register must be lifted and re-applied. This sort of trial-and-error approach is slow and laborious.

An apparatus for fixing the location of rubber printing plates before they are mounted has been disclosed by Jackson in U.S. Pat. No. 3,983,808. Each plate is stretched as both of its ends are pinned to a slide. Then, the plate is rolled from the slide onto a printing cylinder. The same pin locations are used for successive plates which are known to have different stretch characteristics. Accordingly, accurate registry of the images on successive plates cannot be achieved. Furthermore, neither the method nor the apparatus is suitable for use with dimensionally stable flexographic printing plates. A more specific disadvantage in mounters of the type disclosed by Jackson is the large number of precision drilled apertures required for any given range of plate and cylinder sizes.

DISCLOSURE OF INVENTION

With the simplified apparatus disclosed herein, accurate register between successive printing plates can be achieved in a minimum of time. The apparatus has a frame that includes apertured side bars and a support structure between the side bars. The support structure provides a level support for a flexible printing plate and includes a cross bar that is slideable on the side bars. The cross bar is located with respect to the side bars by a first set of keys. A second set of keys extends through registration apertures in the printing plate into apertures in the cross bar. The frame is adjustably mounted so that the web can be positioned axially of and tangentially to a printing cylinder on which the plate is to be mounted. With this arrangement, any given range of plate and cylinder sizes can be accommodated with a minimum number of precise apertures.

DESCRIPTION OF DRAWINGS

Other objectives and advantages of the registration apparatus will be apparent from the following description wherein reference is made to the accompanying drawings in which.

DESCRIPTION OF APPARATUS

Figure 1:
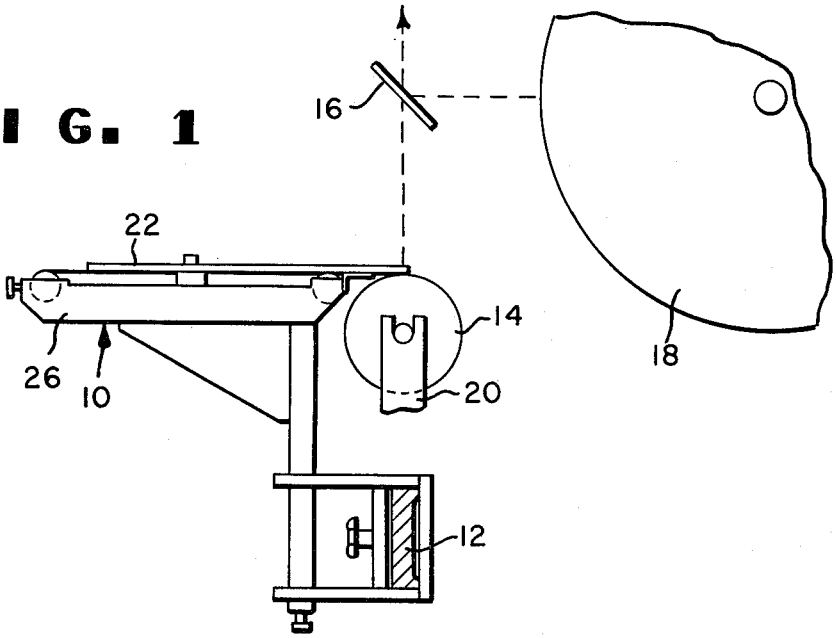
FIGS. 1 and 2 are side and perspective schematics of the registration apparatus in association with parts of a mounter-proofer.

In FIG. 1, the apparatus of the present invention has been designated 10 and shown bracketed to rail 12 of a mounter-proofer. Apparatus 10 is closely adjacent and has its upper surface disposed tangentially to a printing cylinder 14. The mounter-proofer includes an optical system 16 that may be used to establish the horizontal location of a printing plate on apparatus 10 with respect to a proofing cylinder 18. Cylinders 14,18 are geared together to prevent relative motion and can be turned with a hand wheel on the mounter-proofer. Fittings to receive cylinder 14 have been shown schematically at 20 and are parts of the mounter-proofer. Once the apparatus 10 is in place a flexible, printing plate 22 is properly aligned when pinned in place and can then be adhered to printing cylinder 14.

Figure 2:
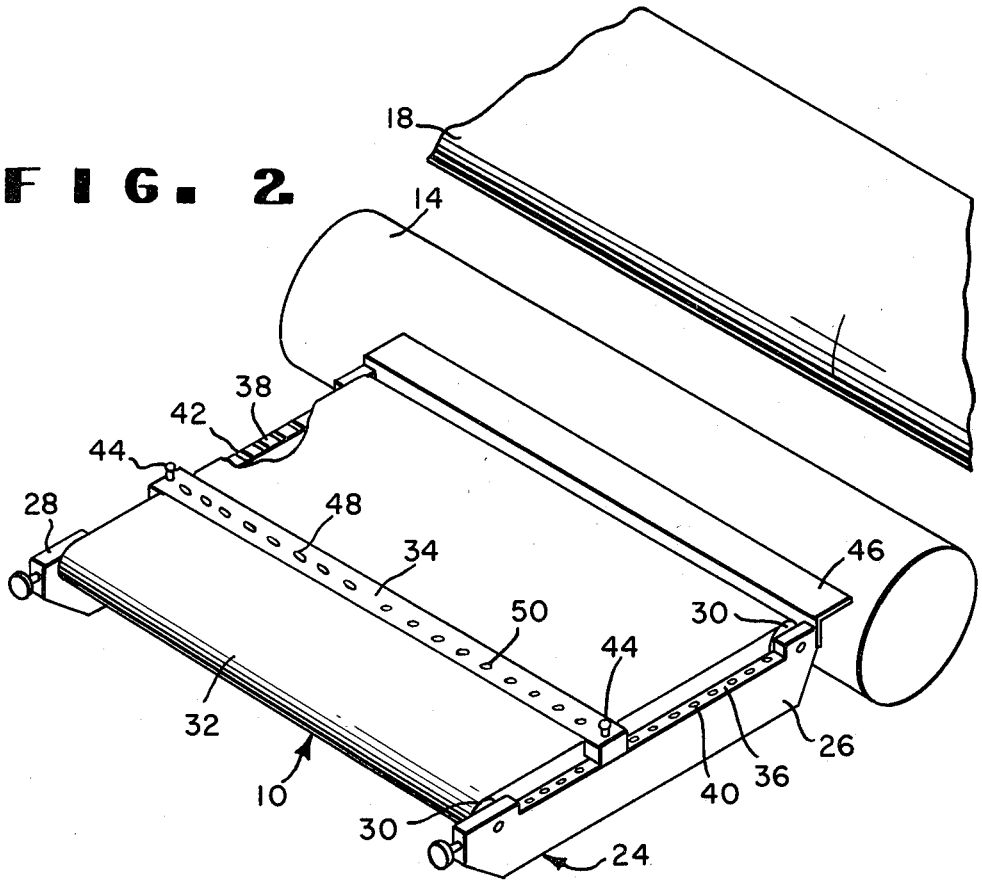

As shown in FIG. 2, apparatus 10 includes a frame 24 having spaced side bars 26,28 and a pair of rolls 30 disposed between the side bars. An endless web 32 is trained over rolls 30 and carries in its length a cross bar 34.

Figures 3, 4, 5, 10:
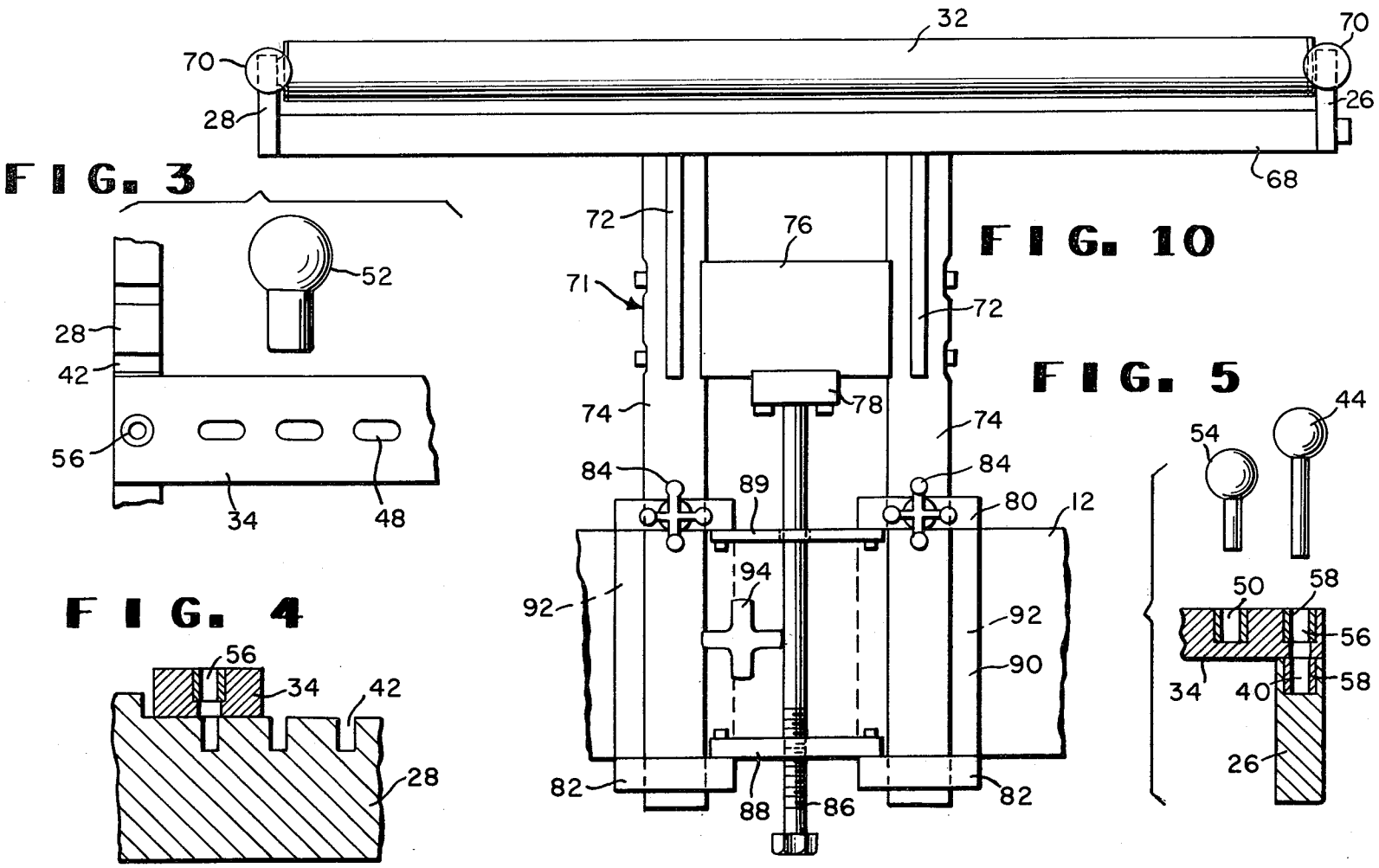
FIGS. 3,4 and 5 are fragmentary views showing details of the registration keys and apertures.
FIGS. 10 and 11 are front and side views showing the apparatus in place on the rail of a mounter-proofer.

Bar 34 has a thickness substantially equal to the depth of recessed lengths 36,38 of side bars 26,28. Length 36 has a number of equispaced, round apertures of keyways 40 and length 38 has the same number of apertures in the form of keyslots 42. Cross bar 34 is located with respect to side bars 26, 28 by keys 44. When so located, the tops of bar 34 and web 32 as well as a shelf 46 present a level support surface for a flexible printing plate that is tangentially disposed with respect to printing cylinder 14 when apparatus 10 is properly positioned. Bar 34 is provided with a number of equispaced apertures 48 in the form of keyslots on one side of its center line and has similarly spaced round apertures 50 on the other side. Apertures 48 receive keys 52 (FIG. 3) that have pins of the same configuration as the keyslots. Apertures 50 receive keys 54 that have round pins (FIG. 5). The longer keys 44 have round pins and are used in apertures 56 at the ends of bar 34 to fix its location with respect to side bars 26,28. Apertures 40, 50, 56 are actually in drill bushings 58. Obviously, apertures 48 and the pins on keys 52 could also be round.

Figures 11, 12, 13:
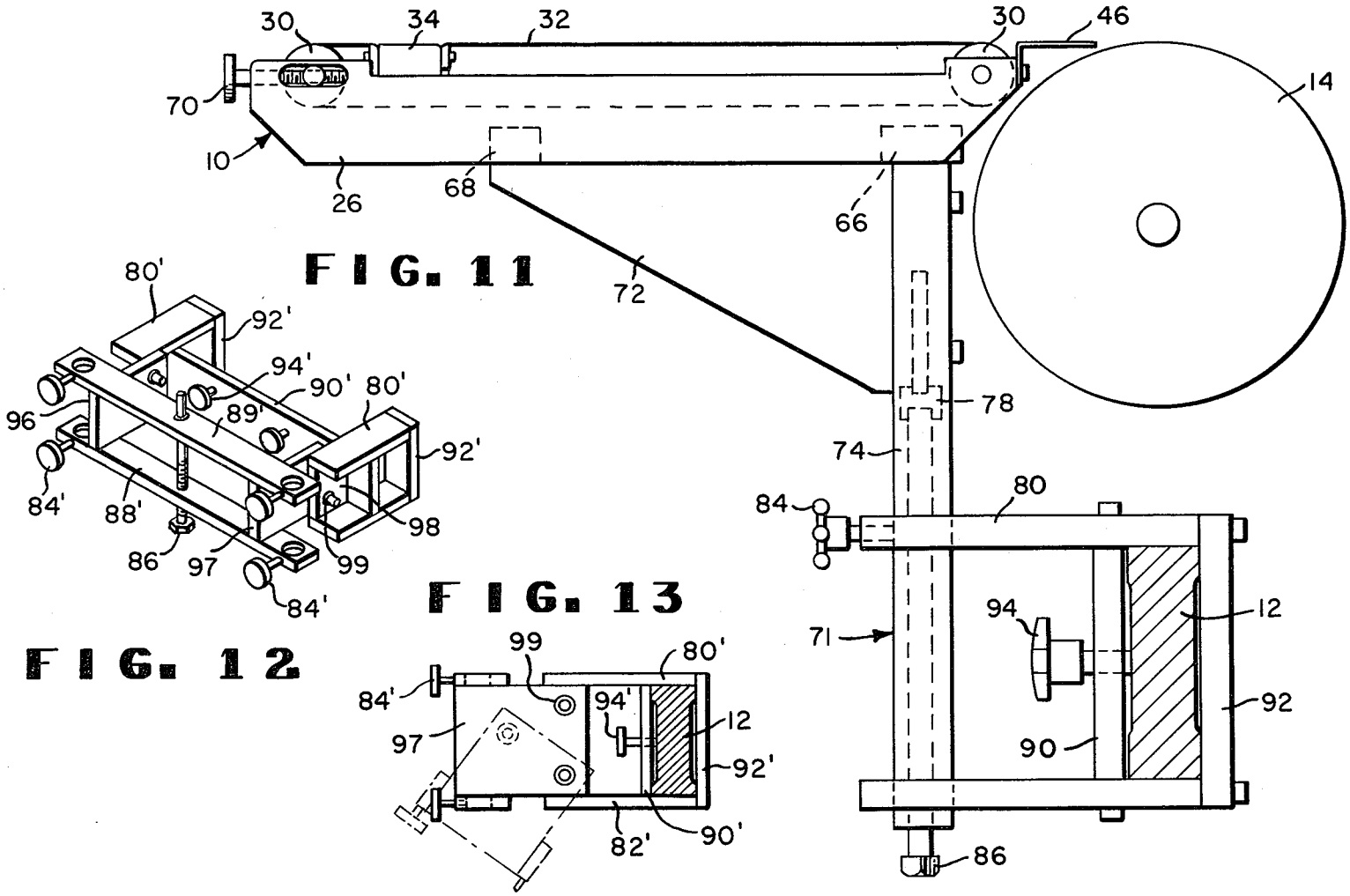
FIGS. 12 and 13 are schematic perspective and side views of a hinged bracket for the apparatus.

As mentioned above, apparatus 10 is adjusted vertically until the support structure, including web 32, bar 34 and shelf 46, is tangentially disposed with respect to printing cylinder 14. The apparatus 10 is adjusted axially of cylinder 14 until a vertical index mark on plate 22 (FIG. 6) is aligned in optics system 16 with a circumferentially disposed index mark on proofing cylinder 18 (FIG. 2). The manner in which the apparatus can be moved vertically and axially with respect to cylinders 14,18 is shown in FIGS. 10,11 and will be described below.

Figure 6:
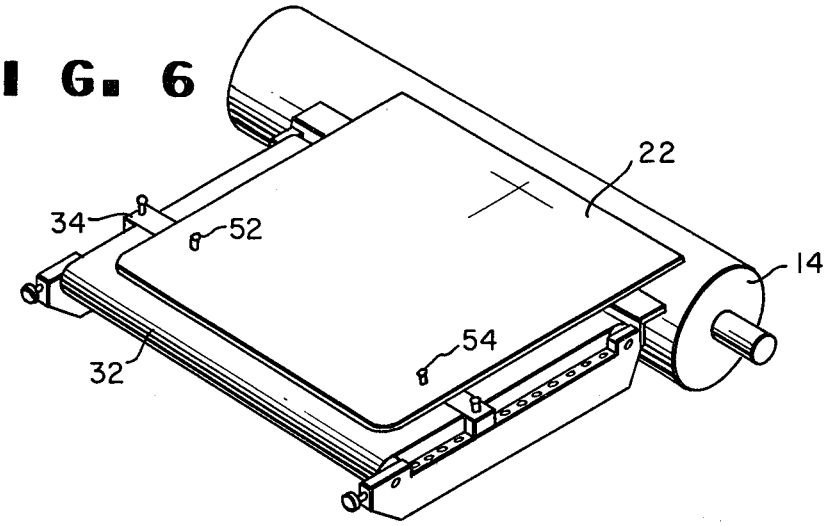
FIGS. 6 and 7 are perspective schematics that show how a flexible printing plate is located with respect to a printing cylinder and then mounted.

As shown in FIG. 6, web 32 and cross bar 34 function as a support structure for a printing plate 22. The plate is located on web 32 by a pair of keys 52,54 which have pins that extend through apertures in the printing plate into apertures 48,50 in cross bar 34. Once apparatus 10 has been positioned properly with respect to the mounter-proofer, plate 22 can be pinned in place and moved with web 32 and cross bar 34 until the horizontal index marks are aligned approximately. Then, the support structure is locked in place by placing keys 44 in apertures 40,42. With the cross bar 34 so located, the free end of the printing plate can be adhered to the adhesively coated surface of printing cylinder 14. Because of the level surface presented by web 32 and shelf 46, there is no opportunity for the plate to sag and thereby affect register accuracy adversely. With the free end of the plate adhered to the printing cylinder, keys 52,54 are detached and cylinder 14 is turned by the hand wheel on the mounter-proofer. As cylinder 14 is turned, the rest of plate 22 is adhered (FIG. 7) and, after the usual preparatory steps, can be proofed on cylinder 18. As explained more fully hereinafter, the apertures in the several plates 22 for a given printing run are punched at the same spacing as holes in negatives of the original art work or photography. Thus, successive plates 22 can be mounted in register simply by replacing the cylinder 14, pinning the next plate to the same apertures in cross bar 34 and repeating the sequence of steps outlined above.

Figure 8:
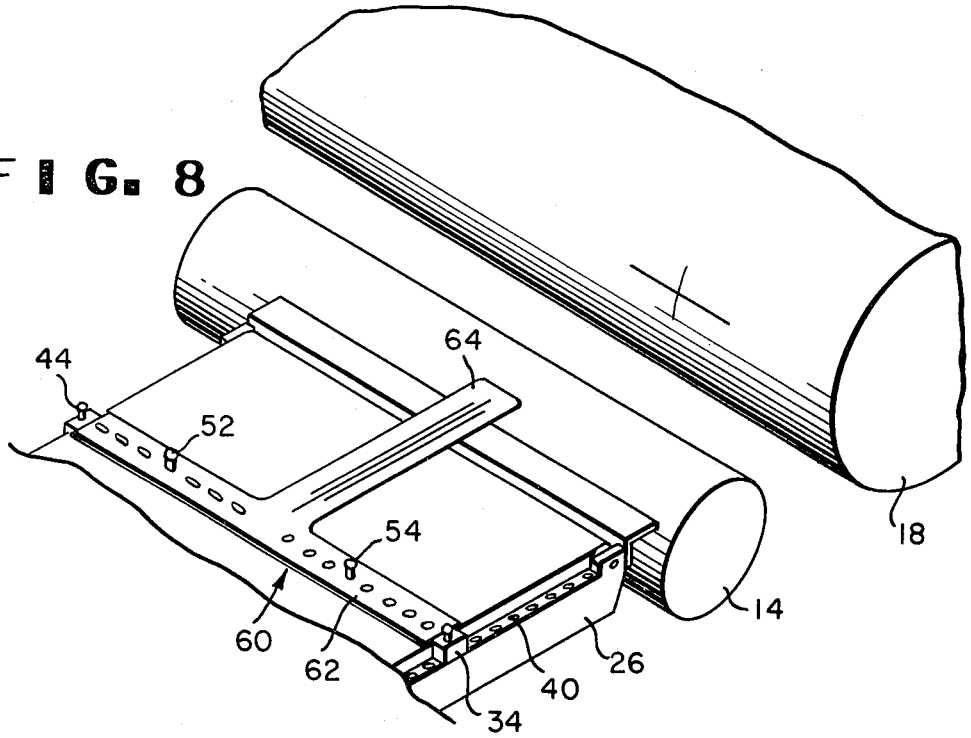
FIGS. 8 and 9 illustrate centering templates that can be attached and used to locate the apparatus on a mounter-proofer.

Instead of relying on an index mark on a printing plate, the correct axial position of apparatus 10 can be determined with a template 60 (FIG. 8). Template 60 is T-shaped, has an apertured cross piece 62 and a scribed leg 64. The apertures in cross piece 62 are of the same configurations and spacing as the apertures in cross bar 34. The scribe marks on leg 64 are spaced at half the distance between the apertures in the cross bar. If keys 52,54 are in holes equally spaced from the center of the template, the middle scribe mark on leg 64 is aligned optically with the vertical center line marked on proofing cylinder 18. If key 52 is located one aperture further from the center than key 54, the right-hand scribe mark is used. If key 54 is located one aperture further from the center than key 52, the left-hand scribe mark is used. Thus, the keys are spaced at the same distance as the space between registration apertures in the plates 22 and the scribe mark corresponding to the center line of the imaged area of the plates is used to position apparatus 10. Use of the template 60 avoids the possibility of damaging one of the plates as apparatus 10 is positioned.

Figure 9:
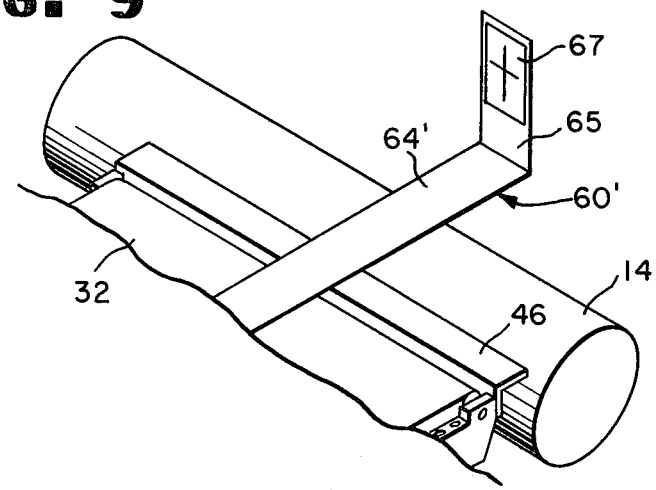

An alternate form of the template has been designated 60′ in FIG. 9. Template 60′ includes a leg 64′ having an upright extension 65. Extension 65 has a window that is fitted with a transparent sheet 67. Cross hairs on sheet 67 facilitate location of the apparatus both axially and vertically with respect to a printing cylinder 14. Thus, template 60′ eliminates the need for an optical system of the type shown at 16 in FIG. 1.

Additional structural features of the apparatus 10 are shown in FIGS. 10 and 11. Rolls 30 are journalled in side bars 26,28 and the side bars are also joined by lateral frame members 66,68. Bars 26,28 carry belt-tensioning screws 70. The free ends of web 32 are fastened to the sides of bar 34.

A mounting bracket 71 for the apparatus 10 has also been shown in FIGS. 10,11. It includes triangular shaped reinforcement plates 72 that join frame members 66,68 to upright legs 74. Between legs 74, there is a fixed plate 76 to which is attached a pressure block 78. Legs 74 are slidable in arms 80,82 and are held in place by clamping screws 84. Fine adjustments of the vertical position of apparatus 10 are accomplished with a height adjustment screw 86 that is threaded through a bar 88 attached to lower arms 82. Screw 86 also extends through a spacer bar 89 that is attached to upper arms 80. The end of screw 86 bears against block 78.

Arms 80,82 are also attached to slide plates 90,92. The bracket 71 is positioned on a mounter-proofer by removing plates 92, fitting arms 80,82 over rail 12, and replacing plates 92. The bracket can be moved axially along rail 12 until properly positioned and can then be clamped to the rail by a screw 94 that is threaded through plate 90 and adapted to engage rail 12.

Bracket 71 is first placed on rail 12 and then adjusted at screw 86 until web 32 and shelf 46 of apparatus 10 are tangential to whatever size of cylinder 14 is to be used. With either a printing plate or a centering template pinned to cross bar 34, the bracket is positioned axially of the cylinders 14,18 and then clamped to rail 12.

Figure 7:
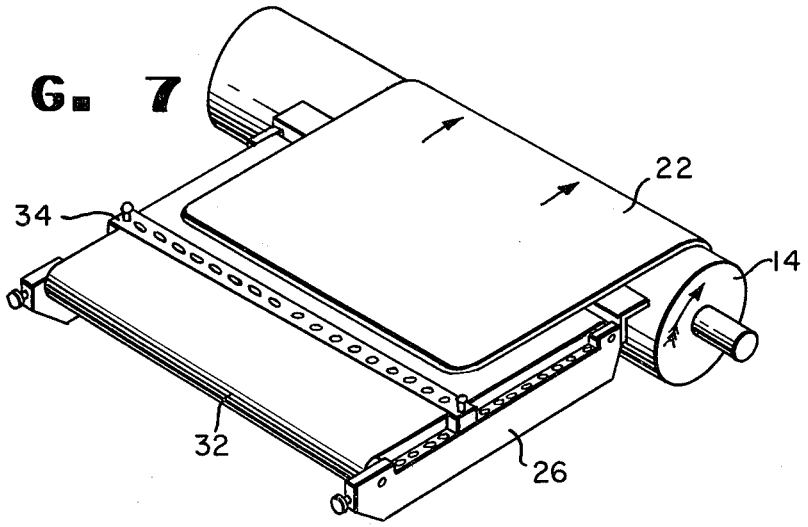

Apparatus 10 is especially adapted for use in mounting dimensionally stable flexible printing plates, e.g., CYREL® elastomeric relief plates for flexographic printing. As recognized in *Industrial Research* Magazine, October 1974, pages 23, 38, CYREL photopolymer flexographic printing plates are photopolymerizable printing plates. Such plates can be exposed through conventional photographic negatives. First, one sheet of film for each color to be printed is punched at two locations spaced to correspond with the space between two of the apertures 48,50 in cross bar 34. Each film is then registered over pins in the back of a camera and exposed, with an appropriate filter, to the original copy. After flexographic printing plate material has been cut to the approximate size desired, opposed margins are punched with the same aperture spacing as the film. Each plate is registered over pins with a film negative, exposed to actinic light and then processed. The plates 22 are then ready to be mounted on printing cylinders 14, as shown in FIGS. 6,7.

In those instances where either the size of the printing cylinders or structural features of the mounter-proofer make it difficult or inconvenient to change cylinders with the registration apparatus in place, a pivotal connection can be included in the bracket. Such a modified bracket has been shown in FIGS. 12 and 13. In this embodiment, the pieces mounted on rail 12 are relatively wider than in the embodiment of FIGS. 10,11 and two clamping screws 94′ are provided. Elongated bars 88′,89′ are apertured to receive legs 74 and each is provided with a pair of clamping screws 84′. A height adjustment screw 86′ is threaded in bar 88′ and passes through an aperture in bar 89′. Bars 88′,89′ are spaced by and attached to plates 96,97 and the latter are, in turn, fastened to plates 98 by rods that extend through drill jig bushings 99 in plates 96,97, 98. When the upper rods are removed, the parts of the bracket on which apparatus 10 is mounted can be pivoted to the broken line position shown in FIG. 13 while a cylinder 14 is replaced. The apparatus can then be returned to its operable position for mounting a printing plate on the replacement cylinder 14.

Figure 14:
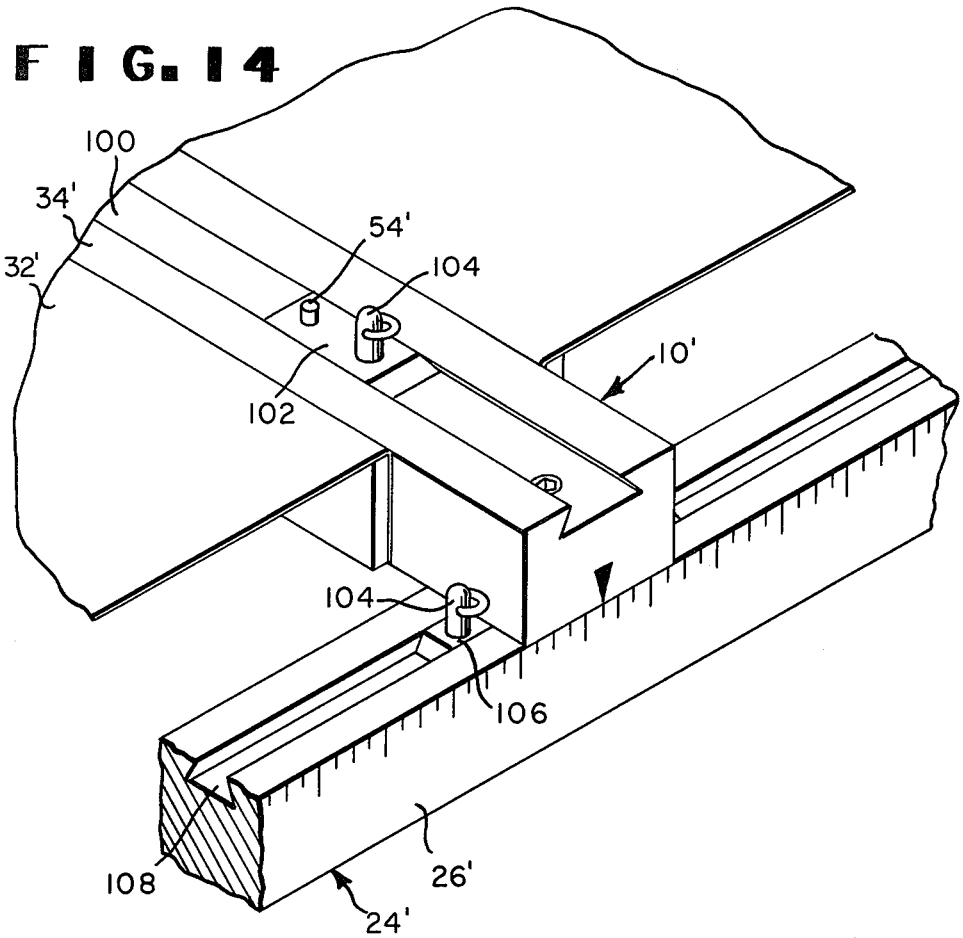
FIGS. 14,15 are fragmentary perspective and sectional views of an alternate embodiment of the apparatus.
Figure 15:
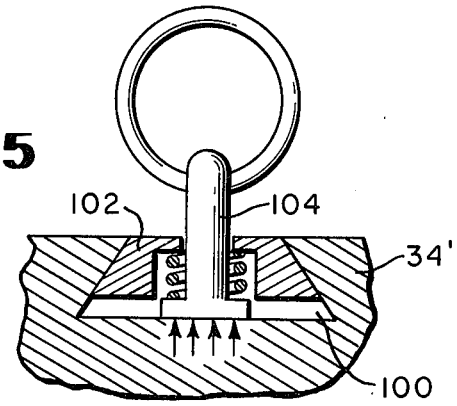

An alternate embodiment of the registration apparatus has been designated 10′ in FIG. 14. This embodiment has a frame 24′ that includes a pair of side bars, one of which is shown at 26′. Rolls are journalled in the side bars and a web 32' is trained over the rolls. The free ends of web 32' are fastened to the sides of a cross bar 34'.

The upper surface of cross bar 34' is flush with the web 32' and is provided with a dovetail keyway 100. A pair of keys 102 ride in keyway 100 and are locked in place by spring-biased plungers 104. Each key 102 carries an integral pin 54' that fits through apertures in a printing plate. A key 106 is attached to the lower surface of bar 34' at each of its ends. Each key 106 rides in a dovetail keyway 108 and is locked in place by a plunger 104. There is a scale on side bar 26' and cross bar 34' can be located by aligning a pointer on its end with a desired index mark on the scale.

What is claimed as new and desired to be secured by Letters Patent is:

1. Apparatus for locating a flexible plate with respect to a printing cylinder, said apparatus comprising:

a frame including side bars;

a support structure between said side bars, said structure providing a flat platform for a plate and including a cross bar mounted for sliding movement between predetermined positions on said side bars, said cross bar having positionable keys adapted to project through registration apertures in a printing plate; and locking means for fixing the location of said cross bar at one selected position with respect to said side bars such that said cross bar remains stationary with respect to said frame as the printing cylinder is rotated to apply a flexible plate thereto.

2. The apparatus of claim 1 wherein said side bars and said cross bar are apertured, said locking means comprises keys having pins extending through apertures in said cross bar into apertures in said side bars.

3. The apparatus of claim 1 wherein said side bars are provided with dovetail keyways and said locking means comprises similarly shaped keys on said cross bar.

4. Apparatus for locating a flexible plate with respect to a printing cylinder, said apparatus comprising:

a frame including side bars;

a support structure between said side bars, said structure providing a flat platform for a plate and including a cross bar mounted for sliding movement on said side bars, said support structure also including a pair of rollers disposed between said side bars and a web trained over said rollers, said web being attached at its ends to said cross bar, said cross bar having positionable keys adapted to project through registration apertures in a printing plate; and locking means for fixing the location of said cross bar with respect to said side bars.

5. The apparatus of claim 4 wherein said cross bar has apertures therein, said apertures in said cross bar being disposed in a flat surface on said cross bar, said surface being flush with said web.

6. The apparatus of claim 4 wherein said apparatus further comprises a bracket for mounting said frame with said web disposed tangentially to a positioned printing cylinder.

7. The apparatus of claim 6 wherein said bracket includes a pivotal connection permitting swinging movement of said frame away from a printing cylinder.

8. In a mounter-proofer including a transverse rail and fittings aligned with the rail for receiving a printing cylinder, apparatus for aligning a flexible printing plate relative to the cylinder, said apparatus comprising:

a frame including side bars and a pair of rollers disposed between said bars;

means mounting the frame on the rail for adjustments transversely and vertically with respect to a printing cylinder;

an elongated web having ends thereon; and a cross bar interconnecting the ends of said web, said web being trained over said rollers and tangentially disposed with respect to the cylinder when said frame is properly adjusted, said side bars and said cross bar having keyways to receive keys for locating a printing plate with respect to said cross bar and said cross bar with respect to the cylinder.

* * * * *